US011317697B2

(12) United States Patent
Oh

(10) Patent No.: US 11,317,697 B2
(45) Date of Patent: May 3, 2022

(54) COSMETIC STICK CASE USING MAGNETIC FORCE

(71) Applicant: Amorepacific Corporation, Seoul (KR)

(72) Inventor: Ju Won Oh, Seoul (KR)

(73) Assignee: Amorepacific Corporation, Seoul (KR)

( * ) Notice: Subject to any disclaimer, the term of this patent is extended or adjusted under 35 U.S.C. 154(b) by 15 days.

(21) Appl. No.: 16/992,630

(22) Filed: Aug. 13, 2020

(65) Prior Publication Data

US 2021/0085058 A1 Mar. 25, 2021

(30) Foreign Application Priority Data

Sep. 20, 2019 (KR) ..... 10-2019-0116072

(51) Int. Cl.

| | |
|---|---|
| ***B43K 7/12*** | (2006.01) |
| ***A45D 40/12*** | (2006.01) |
| ***A45D 40/02*** | (2006.01) |
| ***A45D 40/04*** | (2006.01) |
| ***A45D 40/06*** | (2006.01) |
| *A45D 40/00* | (2006.01) |
| *A45D 40/10* | (2006.01) |

(52) U.S. Cl.

CPC ..... *A45D 40/12* (2013.01); *A45D 40/02* (2013.01); *A45D 40/023* (2013.01); *A45D 40/04* (2013.01); *A45D 40/06* (2013.01); *A45D 40/065* (2013.01); *A45D 2040/0006* (2013.01); *A45D 2040/0025* (2013.01); *A45D 2040/105* (2013.01)

(58) Field of Classification Search

CPC ..... A45D 40/02; A45D 40/023; A45D 40/04; A45D 40/06; A45D 40/065; A45D 40/12; A45D 2040/0006; A45D 2040/0025; A45D 2040/10; A45D 2040/105

USPC ..... 401/100

See application file for complete search history.

(56) References Cited

U.S. PATENT DOCUMENTS

| | | | | |
|---|---|---|---|---|
| 8,556,527 | B1 * | 10/2013 | Chou | A45D 40/04 401/98 |
| 2016/0183661 | A1 * | 6/2016 | Lefevre | A45D 34/043 401/100 |
| 2017/0196339 | A1 * | 7/2017 | Kim | A45D 40/065 |

FOREIGN PATENT DOCUMENTS

| | | | |
|---|---|---|---|
| KR | 20-0165237 | Y1 | 2/2000 |
| KR | 20-0487954 | Y1 | 11/2018 |
| KR | 20200127363 | A * | 11/2020 |

* cited by examiner

*Primary Examiner* — Jennifer C Chiang
(74) *Attorney, Agent, or Firm* — Sughrue Mion, PLLC

(57) ABSTRACT

A cosmetic stick case contains a magnetic member. The cosmetic stick case includes a cosmetic stick body, a cosmetic stick inserted into the cosmetic stick body, and a push button for drawing out the cosmetic stick to an outside by a pressing operation. The cosmetic stick body contains a first magnetic force member and the push button contains a second magnetic force member. Attractive force between the first magnetic force member and the second magnetic force member keeps the push button in a fixed state without being shaken while the push button is inserted into the cosmetic stick body.

18 Claims, 18 Drawing Sheets

COSMETIC STICK CASE USING MAGNETIC FORCE

CROSS-REFERENCE TO RELATED APPLICATIONS

The subject application claims the benefit of Korean Patent Application No. 10-2019-0116072, filed on Sep. 20, 2019, the disclosure of which is hereby incorporated by reference in its entirety.

BACKGROUND OF THE INVENTION

1. Field of the Invention

One aspect of the present disclosure relates to a cosmetic stick case, and more specifically, to a cosmetic stick case, in which a push button for drawing a cosmetic stick out of a cosmetic stick case is fixed in a pressed state or returned to its initial position by attractive and repulsive force of a magnet, thereby improving usability and productivity.

2. Description of the Prior Art

In general, cosmetics are used by people to improve their appearance. The cosmetics may be divided into a base makeup cosmetic for correcting a tone of a skin and a point makeup cosmetic for emphasizing a specific portion of a body.

The base makeup cosmetics may include a foundation, a powder, a BB cream, and the like and the point makeup cosmetics may include a lipstick, a lip gloss, an eyeliner and the like.

The point makeup cosmetics may be divided into liquid-type or gel-type cosmetics, stick-type cosmetics, etc., depending on the formulation thereof. The stick-type cosmetics may be formed of solid cosmetics, such as a cosmetic stick or a foundation, and a tip portion of the stick cosmetics is applied to the site of use.

Among the stick-type cosmetics, the cosmetic stick is used for lip makeup, in which contents having various colors are provided in a rod shape and the cosmetic stick appears as a container body rotates so that the cosmetic stick can be applied to the user's lip.

As an example of conventional cosmetic stick containers, a cosmetic stick case has been disclosed in Korean Utility Model Registration No. 20-0165237, in which a guide tube having a spiral groove and a rotary tube having a vertical guide hole and an injection hole are inserted into an inside of an outer case, a cosmetic stick holder having a guide protrusion is inserted into an inside the rotary tube, a cosmetic stick is fixedly formed the cosmetic stick holder, and a guide protrusion is coupled in a state in which the guide hole of the rotary tube matches the spiral groove of the guide tube. Thus, when the rotary tube is rotated, the guide protrusion of the cosmetic stick holder moves up and down along the spiral groove of the guide tube, so that the cosmetic stick is drawn out and used.

In addition, the conventional cosmetic stick container as described above is equipped with a lid to prevent foreign substances from entering a container body when stored after using the cosmetic stick. Typically, the lid may be fastened to the cosmetic stick container through an undercut fastening method.

According to the undercut fastening method, a dot-shaped undercut is formed on an outer periphery of a container body, and a ring-shaped undercut is formed on an inner periphery of the lid, so that a user can forcibly fit the lid into the container body or remove the lid from the container body by using the undercut of the container body and the undercut of the lid.

However, since the undercut fastening method requires to forcibly couple or decouple the container body and the lid, the lid may not be easily coupled to or decoupled from the container body. In addition, as the lid is frequently opened and closed, an undercut coupling part becomes loose, thereby causing a problem that the lid is unintentionally separated from the container body.

In order to solve the above problem, Korean Utility Model Registration No. 20-0487954 discloses a cosmetic tool, which includes a lid portion formed therein with a receiving space and having one side being opened, and a body portion provided inside the lid portion, protruding from the lid portion as at least a part of the lid portion is pressed, and formed therein with cosmetics, in which the lid portion includes a restriction member restrained by a locking jaw provided in the lid portion or separated from the locking jaw while pushing the body portion from the lid portion as pressure is applied thereto and a push member that presses the restriction member to release the restriction of the restriction member.

However, according to the above related art, since it is necessary to release the fastening between a rib of the restriction member and the locking jaw in a fixing member by pressing a push button strongly to inwardly bend the rib of the restriction member, it is inconvenient for women with relatively weak force to use the cosmetic tool and there is a problem in that the rib and the locking jaw may be deformed or broken when it is used for a long period of time.

In addition, according to the above related art, a fastening structure between the lid portion, the restriction member and the push member for drawing out the cosmetic stick container is complicated, and the number of parts for the fastening structure is increased, thereby increasing the manufacturing cost and decreasing productivity.

RELATED ART DOCUMENT

Patent Document (Patent Document 0001) Korean Utility Model Registration No. 20-0165237 (issued on Feb. 15, 2000). "Cosmetic stick case"

(Patent Document 0002) Korean Utility Model Registration No. 20-0487954 (issued on Nov. 26, 2018). "Cosmetic tool"

SUMMARY OF THE INVENTION

In order to solve the above problems, an object of one aspect of the present disclosure is to provide a cosmetic stick case using magnetic force, in which a cosmetic stick stored in a cosmetic stick body is drawn out to an outside through a pressing operation of a push button, and the push button is fixed in a pressed state or returned to its initial position by attractive force and repulsive force of a magnet, thereby improving the convenience of use, preventing the push button from being unintentionally shaken so that noise is not generated, and simplifying a drawing structure of the cosmetic stick so that productivity is increased.

In order to accomplish the above object, according to one aspect of the present disclosure, there is provided a cosmetic stick case using a magnetic force, in which the cosmetic stick case includes a cosmetic stick body, a cosmetic stick inserted into the cosmetic stick body, and a push button for drawing out the cosmetic stick to an outside by a pressing operation, wherein the cosmetic stick body is provided with a first magnetic force member and the push button is provided with a second magnetic force member so that the push button is fixed without being shaken by the magnetic force.

The cosmetic stick body may be provided with a first fastening portion and the cosmetic stick may be provided with a second fastening portion so that the cosmetic stick body and the cosmetic stick may be fastened to each other.

One of the first fastening portion and the second fastening portion may be formed of a magnet, and the other may be formed of a magnet or a magnetic member so that the first and second fastening portions may be fastened to each other by the magnetic force.

The first fastening portion and the second fastening portion may be configured as protrusions facing each other so that the first fastening portion and the second fastening portion may be undercut-fastened.

At least two fastening portions may be provided on the cosmetic stick so that the cosmetic stick may be prevented from being completely separated from the cosmetic stick body when the cosmetic stick is drawn out.

The first magnetic force member and the second magnetic force member may have ring shapes.

The cosmetic stick body may be formed at an inner periphery thereof with a latching protrusion, which protrudes inward, so that the second magnetic force member of the push button may be caught by the latching protrusion when the push button is pressed.

The cosmetic stick body and the push button may be provided with a linear guide groove and a linear guide protrusion, respectively, to guide a linear movement of the push button.

One of the first magnetic force member and the second magnetic force member may be formed of a magnet, and the other may be formed of a magnet or a magnetic member so that attractive force of the magnet may be generated between the first magnetic force member and the second magnetic force member, thereby fixing the push button in a pressed state upon a pressing operation of the push button.

The first magnetic force member and the second magnetic force member may be formed of magnets having the same pole so that repulsive force of the magnet may be generated between the first magnetic force member and the second magnetic force member, thereby allowing the push button to automatically return to an initial position thereof upon a pressing operation of the push button.

The first magnetic force member may be formed of a pair of magnets having mutually different poles, and the second magnetic force member may be formed of a magnet and positioned between the pair of first magnetic force members.

The second magnetic force member may have a pole the same as a pole of the first magnetic force member, which is positioned in a pressing direction of the push button between the pair of first magnetic force members, to generate repulsive force, and may have a pole different from a pole of the first magnetic force member, which is positioned in a return direction of the push button, to generate attractive force. The attractive force or repulsive force generated between the first magnetic force member and the second magnetic force member may be directed in an operation direction of the push button.

The first magnetic force member and the second magnetic force member may be formed of magnets which are arranged such that different poles are alternately arranged along an operation direction of the push button, and the first magnetic force member and the second magnetic force member may be positioned such that the magnets having mutually different poles face each other.

The attractive force of the magnets may be generated when the first magnetic force member and the second magnetic force member are positioned to face each other, and the repulsive force of the magnets may be generated when the first magnetic force member and the second magnetic force member are positioned to offset from each other.

The attractive force or repulsive force generated between the first magnetic force member and the second magnetic force member may be directed in a direction perpendicular to an operation direction of the push button.

According to one aspect of the present disclosure, the push button for drawing the cosmetic stick out of the cosmetic stick body is fixed in a pressed state or returned to its initial position by the attractive and repulsive force of the magnet, so that the cosmetic stick can be conveniently drawn out by simply pressing the push button, and noise, which is caused by collision between the push button and the cosmetic stick case when the push button is shaken, can be prevented.

Further, according to one aspect of the present disclosure, the structure of drawing out the cosmetic stick from the cosmetic stick body and the structure of fixing the push button or returning the push button to its initial position can be simplified, thereby increasing productivity of the cosmetic stick case.

DETAILED DESCRIPTION OF THE EXEMPLARY ASPECTS

Figure 1:
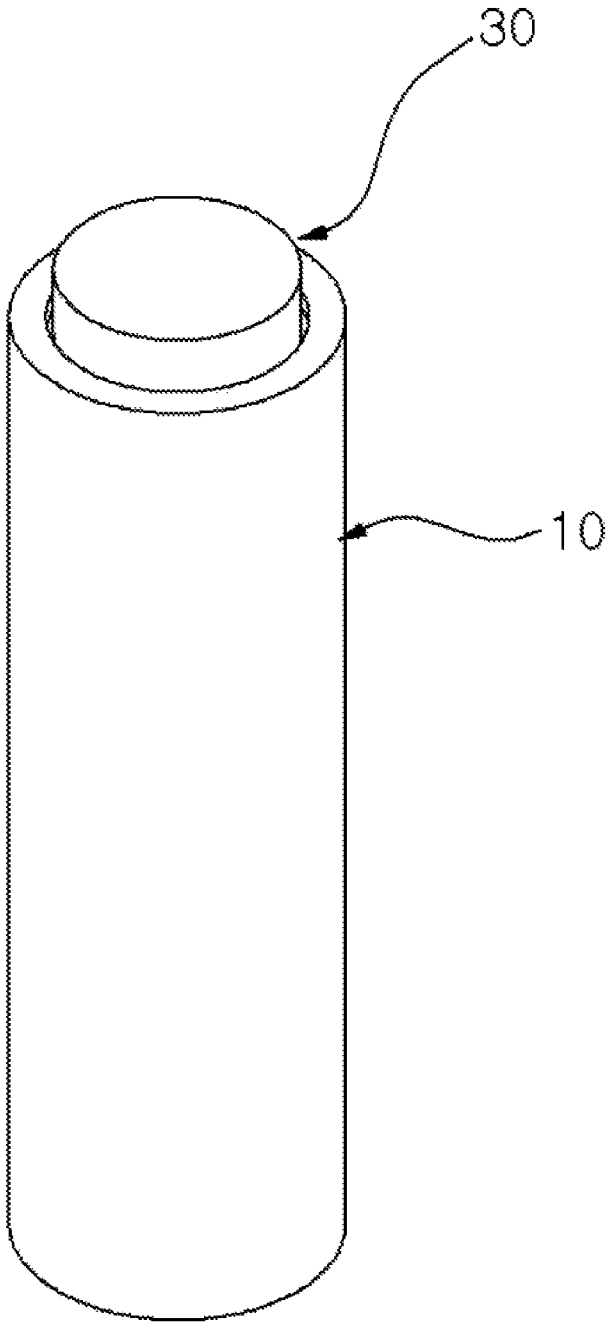
FIG. 1 is a perspective view of a cosmetic stick case according to a first aspect of the present disclosure.

Hereinafter, a cosmetic stick case using magnetic force according to one aspect of the present disclosure will be described in detail with reference to FIGS. 1 to 18.

As shown in the drawings, a cosmetic stick case according to one aspect of the present disclosure may include a cosmetic stick body 10, a cosmetic stick 20 inserted into the cosmetic stick body 10 and a push button 30 for drawing out cosmetic stick 20 by the pressing operation.

In addition, a first magnetic force member 12 may be formed on an inner periphery of the cosmetic stick body 10, and a second magnetic force member 32 may be formed on an outer periphery of the push button 30, so that the push button 30 may be fixed without being shaken due to a magnetic force (a force acting between magnetic poles. That is, a force generated between magnetic objects such as magnets that push or pull each other). A fixing structure of the push button 30 will be described below in more detail with reference to first to fourth aspects of the present disclosure.

Figure 2:
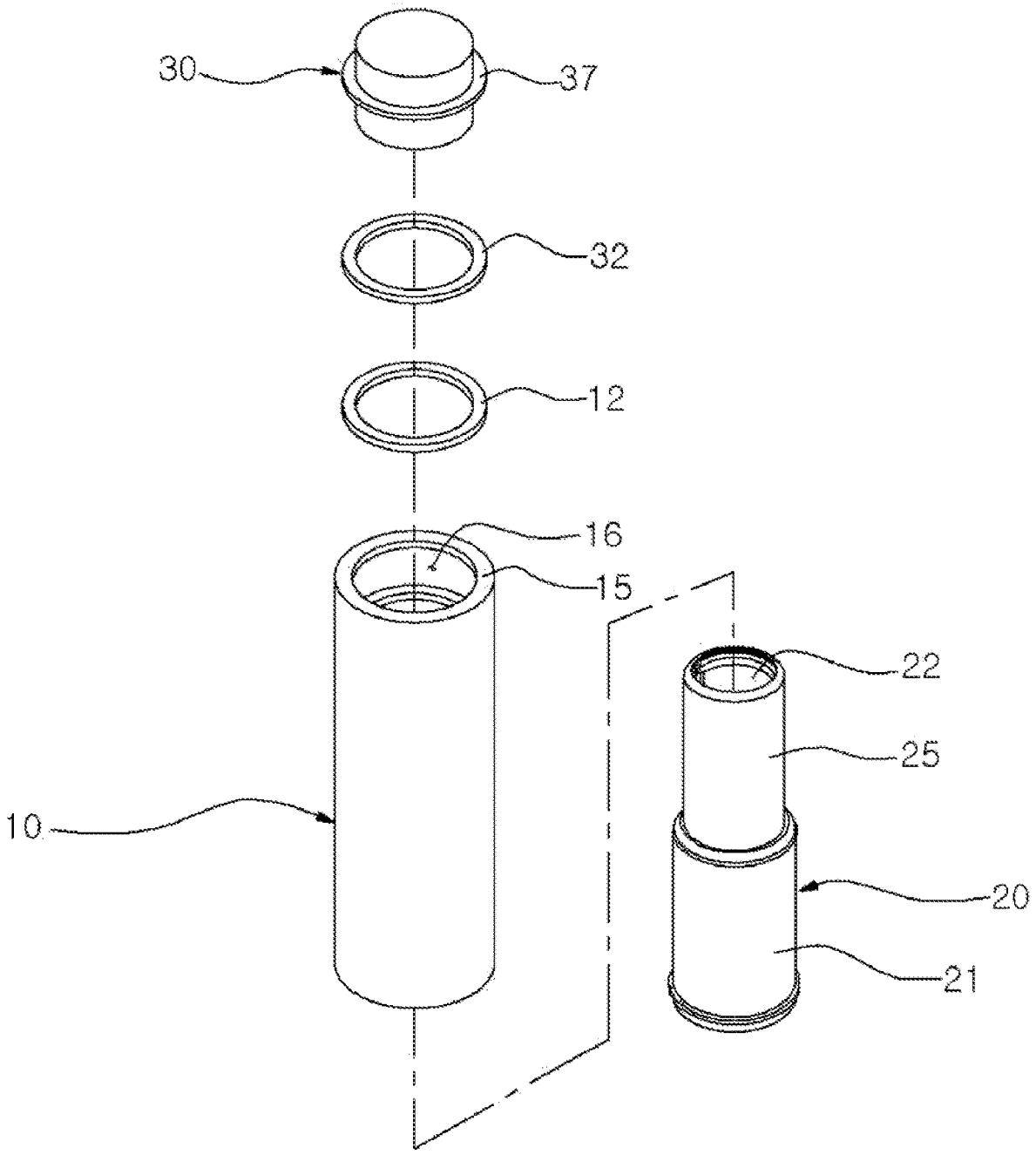
FIG. 2 is an exploded perspective view of a cosmetic stick case according to a first aspect of the present disclosure.

As shown in FIGS. 1 and 2, the cosmetic stick body 10 may have a cylindrical shape with one side being opened, and the cosmetic stick 20 may be accommodated inside the cosmetic stick body 10.

An inlet 14 may be formed at one side of the cosmetic stick body 10, and the cosmetic stick 20 may be inserted into or drawn out of the cosmetic stick body 10 through the inlet 14. Although the cosmetic stick case according to one aspect of the present disclosure is shown with the cosmetic stick body 10 having the cylindrical shape, the present disclosure is not limited thereto. The cosmetic stick case may have various shapes according to convenience of use or preference or fashion of purchasers.

Further, a push button through hole 16 may be formed at an opposite side of the inlet 14 of the cosmetic stick body 10 such that the push button 30 can be accommodated in the push button through hole 16, and a stopper 15 may protrude inward around the push button through hole 16 to prevent the push button 30 from being separated from the cosmetic stick body 10.

In addition, a fastening structure may be formed between the cosmetic stick body 10 and the cosmetic stick 20 such that the cosmetic stick 20 can be detachably coupled to the cosmetic stick body 10. More specifically, a first fastening portion 18 may be formed at an inner periphery adjacent to the inlet 14 of the cosmetic stick body 10, and a second fastening portion 28 may be formed at a lower outer periphery of the cosmetic stick 20 such that the cosmetic stick body 10 and the cosmetic stick 20 can be fastened to each other. Accordingly, the cosmetic stick 20 stably stored in the cosmetic stick body 10 may be pushed by the pressing operation of the push button 30, so that the cosmetic stick 20 may be released from the cosmetic stick body 10 and drawn out through the inlet 14 of the cosmetic stick body 10.

The first fastening portion 18 and the second fastening portion 28 may be provided in the form of protrusions facing each other so that the first fastening portion 18 and the second fastening portion 28 may be undercut fastened. Further, one of the first fastening portion 18 and the second fastening portion 28 may be formed of a magnet, and the other may be formed of a magnet or a magnetic member so that the first fastening portion 18 and the second fastening portion 28 may be fastened to each other through the magnetic force. However, the fastening structure of the cosmetic stick body 10 and the cosmetic stick 20 may not be limited to the above, and various fastening structures may be adopted to the extent that the cosmetic stick 20 can be detachably coupled to the cosmetic stick body 10.

In addition, the first magnetic force member 12 formed on the cosmetic stick body 10 and the second magnetic force member 32 formed on the push button 30 may be configured to have ring shapes, respectively, such that the first magnetic force member 12 and the second magnetic force member 32 may come into close contact with the inner periphery of the cosmetic stick case 10 the outer periphery of the push button 30, respectively.

The push button 30 may be installed in the push button through hole 16 of the cosmetic stick body 10 such that the push button 30 may reciprocally move in the longitudinal direction of the cosmetic stick body 10, and the push button 30 may linearly move by the pressing operation so that the cosmetic stick 20 stored in the cosmetic stick body 10 may be pushed and drawn to the outside.

Figure 3:
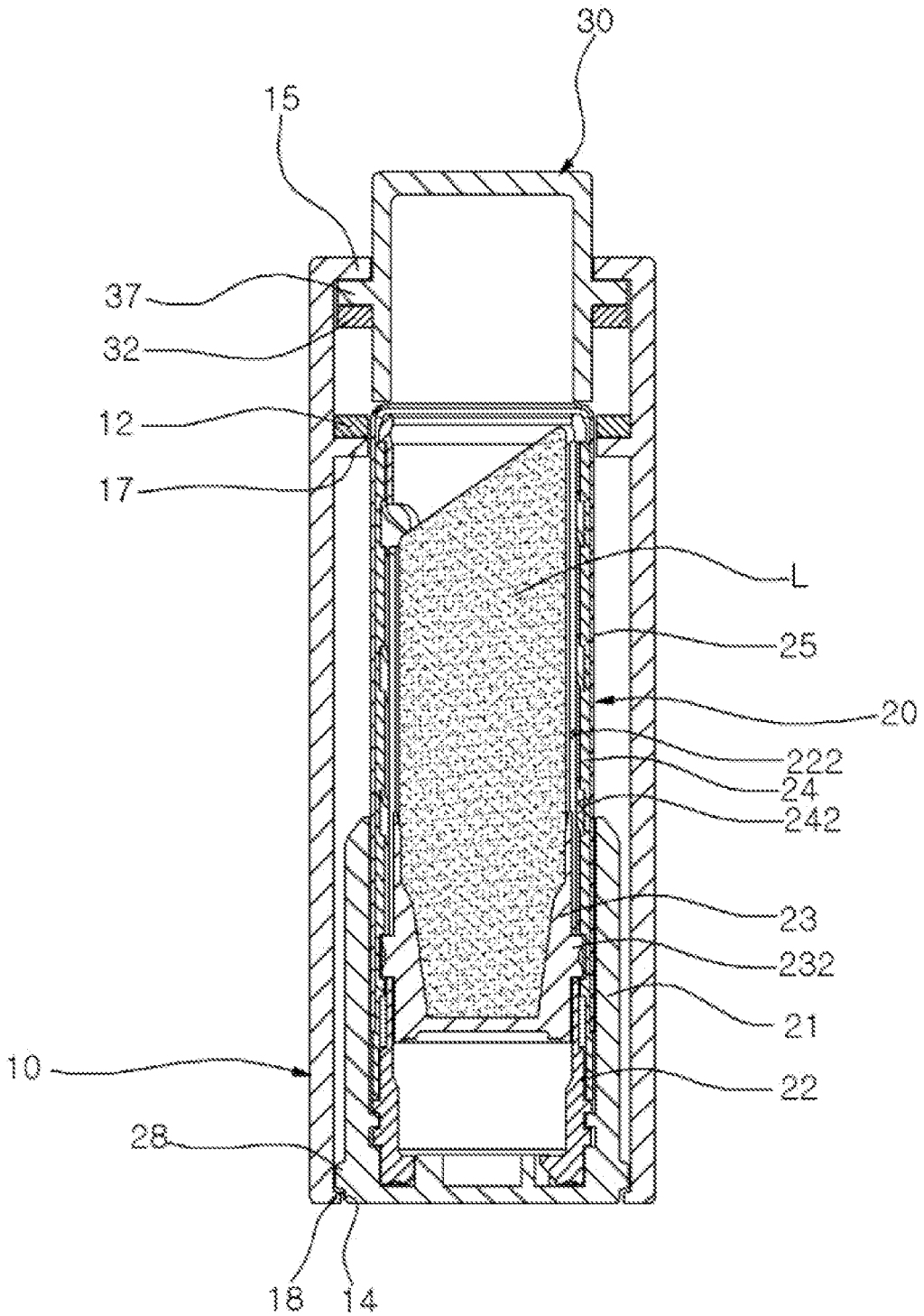
FIG. 3 is a sectional view of a cosmetic stick case according to a first aspect of the present disclosure.

As shown in FIG. 3, the cosmetic stick 20 may be formed therein with a stick cosmetic L, and the stick cosmetic L may be drawn out to the outside through the rotation operation.

In detail, the cosmetic stick 20 may include a cosmetic stick handle 21, a guide member 22, a cosmetic stick dish 23, a lead ring 24 and a protective tube 25.

The cosmetic stick handle 21 may be a part held by a user when performing lip makeup, in which the guide member 22 may be fixedly coupled to the cosmetic stick handle 21 and the lead ring 24 may be rotatably coupled to the cosmetic stick handle 21.

The guide member 22 may have a tubular shape, and a linear guide groove 222 may be longitudinally formed on an outer peripheral surface of the guide member 22.

The cosmetic stick dish 23 may be coupled to an inside of the guide member 22, the stick cosmetics L may be attached to one side of the cosmetic stick dish 23, and a guide protrusion 232 may be formed on the outer peripheral surface of the cosmetic stick dish 23.

The lead ring 24 may be fitted around the guide member 22, and a spiral guide groove 242 may be formed on an inner periphery of the lead ring 24. The guide protrusion 232 of the cosmetic stick dish 23 may extend by passing through the linear guide groove 222 of the guide member 22 so as to be inserted into the spiral guide groove 242 of the lead ring 24. Thus, as the user rotates the cosmetic stick handle 21 while fixing the lead ring 24 with one hand, the cosmetic stick dish 23 may move up and down. The protective tube 25 may be coupled to an outer portion of the lead ring 24 to rotate together with the lead ring 24.

The protective tube 25 may be coupled to an outer portion of the lead ring 24 to protect the lead ring 24.

Due to the above-described components of the cosmetic stick 20, when the user rotates the cosmetic stick handle 21 while holding the protective tube 25 with one hand, the guide protrusion 232 of the cosmetic stick dish 23 may protrude upward out of the protective tube 25 while moving upward along the linear guide groove 222 of the guide member 22 and the spiral guide groove 242 of the lead ring 24. When the user rotates the cosmetic stick handle 21 in a reverse direction, the guide protrusion 232 of the cosmetic stick dish 23 may be inserted into the protective tube 25 while moving downward along the linear guide groove 222 of the guide member 22 and the spiral guide groove 242 of the lead ring 24.

FIGS. 1 to 5 are views showing the cosmetic stick case according to a first aspect of the present disclosure, and the structure and operation of the cosmetic stick case according to the first aspect of the present disclosure will be described below with reference to FIGS. 1 to 5.

As shown in FIG. 3, one of the first magnetic force member 12 and the second magnetic force member 32 may be formed of a magnet, and the other may be formed of a magnet or a magnetic member so that attractive force may be generated between the first magnetic force member 12 and the second magnetic force member 32. Thus, when the push button 30 is pressed, the push button 30 may be fixed in a pressed state.

More specifically, a first protrusion 17 may protrude inward from an inner periphery of the cosmetic stick body 10 adjacent to the push button through hole 16 of the cosmetic stick body 10, so that the first magnetic force member 12 may be fixedly coupled one side of the first protrusion 17. In addition, a second protrusion 37 may protrude outward from an outer periphery of the push button 30, so that the second magnetic force member 32 may be fixedly coupled to one side of the second protrusion 37.

In this case, the first magnetic force member 12 and the second magnetic force member 32 may be formed of magnets having mutually different poles, or may be formed of a magnetic member, such as metal, and a magnet, respectively, so that the attractive force (a pulling force between two objects) may be generated between the first magnetic force member 12 and the second magnetic force member 32.

Figure 4:
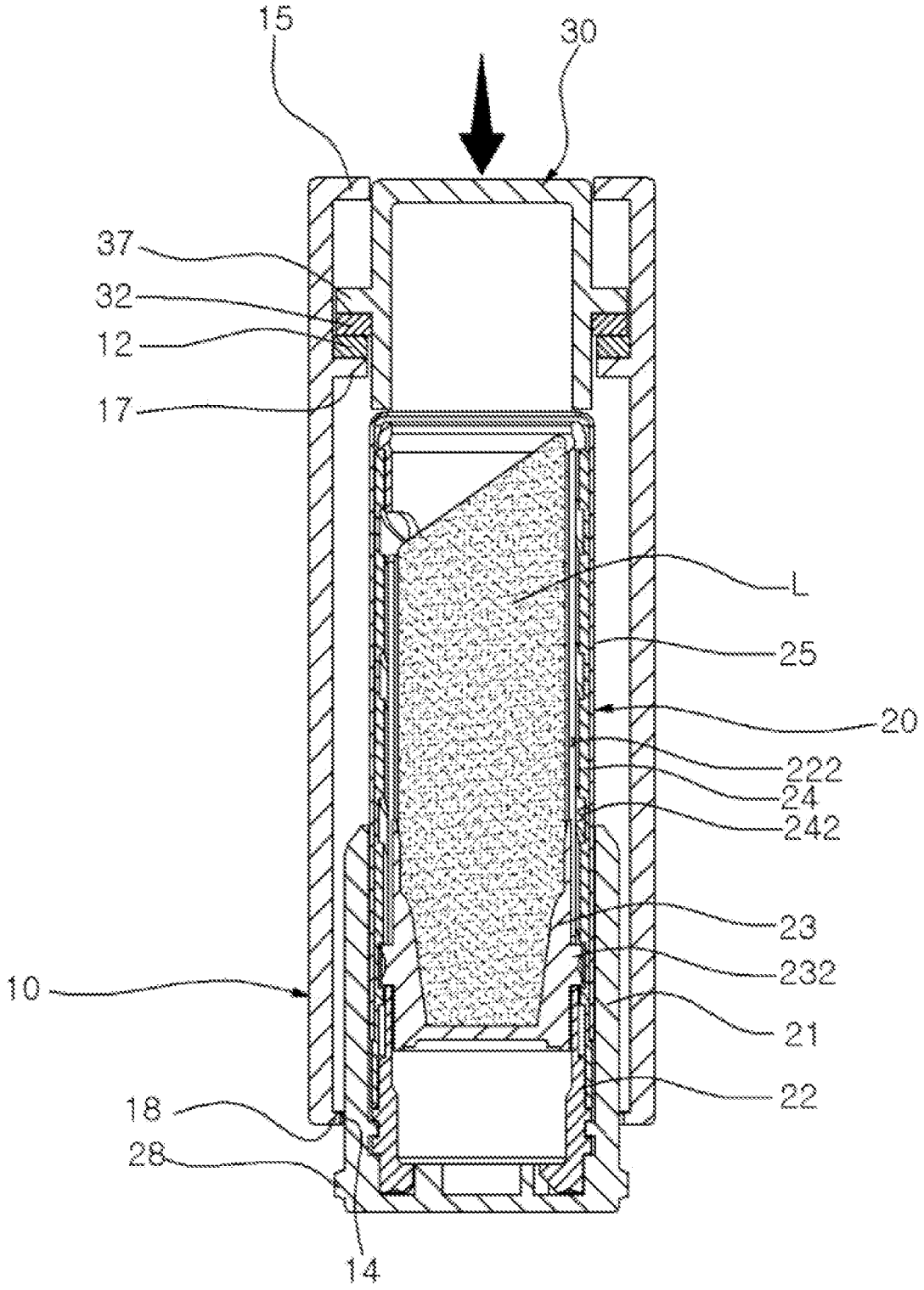
FIG. 4 is a sectional view showing a status of pressing a bush button of a cosmetic stick case according to a first aspect of the present disclosure.

In order to use the cosmetic stick case according to the first aspect of the present disclosure, if the user presses the push button 30 formed on one side of the cosmetic stick body 10 as shown in FIG. 4, an end of the push button 30 may push an end of the cosmetic stick 20 stored in the cosmetic stick body 10 toward the inlet 14. At the same time, the first fastening portion 18 of the cosmetic stick body 10 may be released from the second fastening portion 28 of the cosmetic stick 20 and at least a part of the cosmetic stick 20 may be drawn out to the outside from the cosmetic stick body 10.

Figure 5:
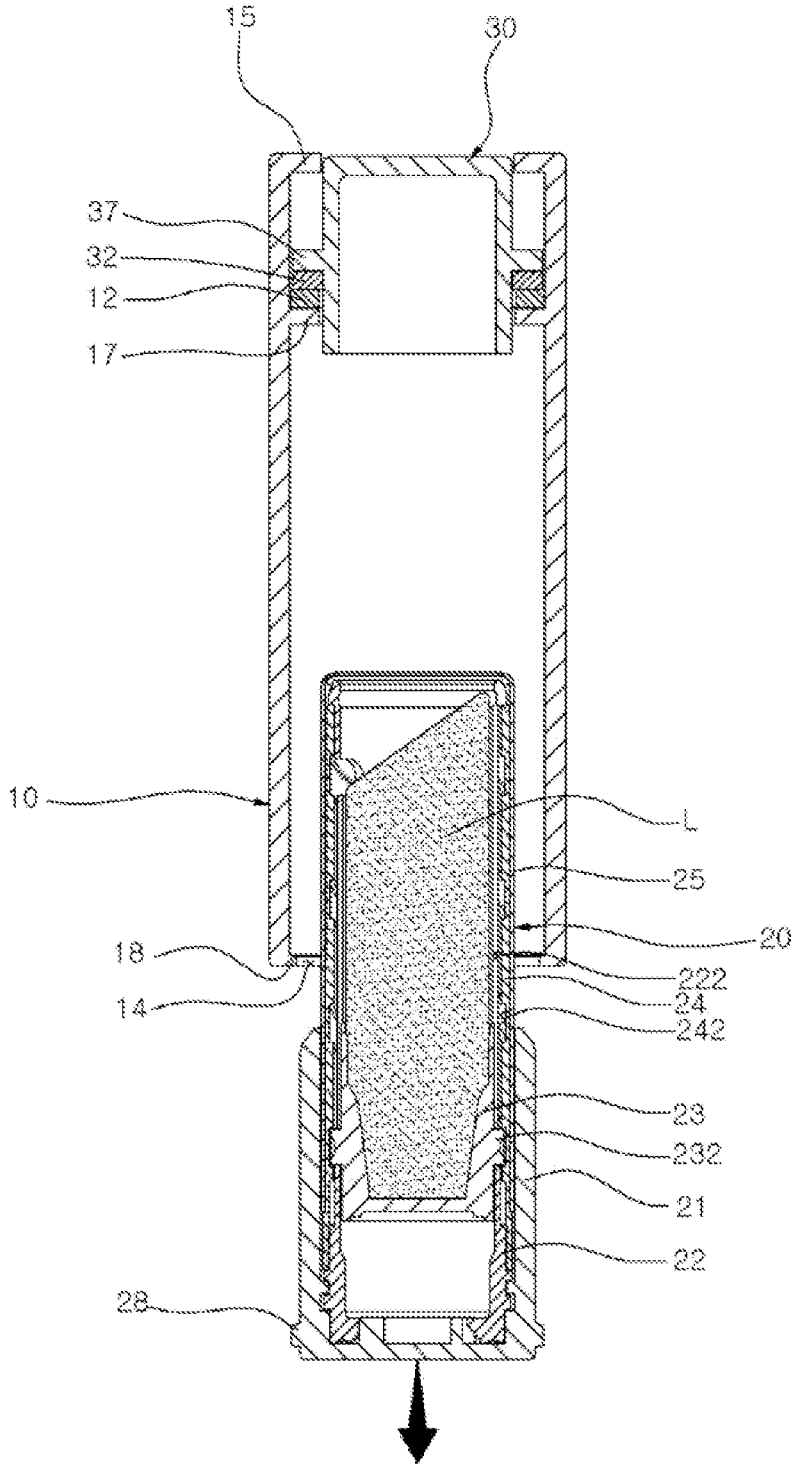
FIG. 5 is a sectional view showing a status of releasing a bush button of a cosmetic stick case according to a first aspect of the present disclosure.

Then, as shown in FIG. 5, even if the pressure applied to the push button 30 is released, the push button 30 inserted into the cosmetic stick body 10 may be kept in the inserted state due to the attractive force between the first magnetic force member 12 and the second magnetic force member 32. Accordingly, the push button 30 may be kept in a fixed state without being shaken from the cosmetic stick body 10, thereby preventing noise caused by collision between the push button 30 and the cosmetic stick body 10.

The second protrusion 37 of the push button 30 may be caught by the stopper 15 of the cosmetic stick body 10 to limit the operation section of the push button 30, and at the same time, to prevent the push button 30 from being separated from the cosmetic stick body 10.

In addition, the first magnetic force member 12 and the second magnetic force member 32 may be disposed to face each other in the operating direction of the push button 30 such that the attractive force of the magnet can be generated between the first magnetic force member 12 and the second magnetic force member 32. That is, the first magnetic force member 12 and the second magnetic force member 32 may be arranged to make direct contact with each other without an obstacle therebetween to avoid the interference on the attractive force generated between the first magnetic force member 12 and the second magnetic force member 32.

Figure 6:
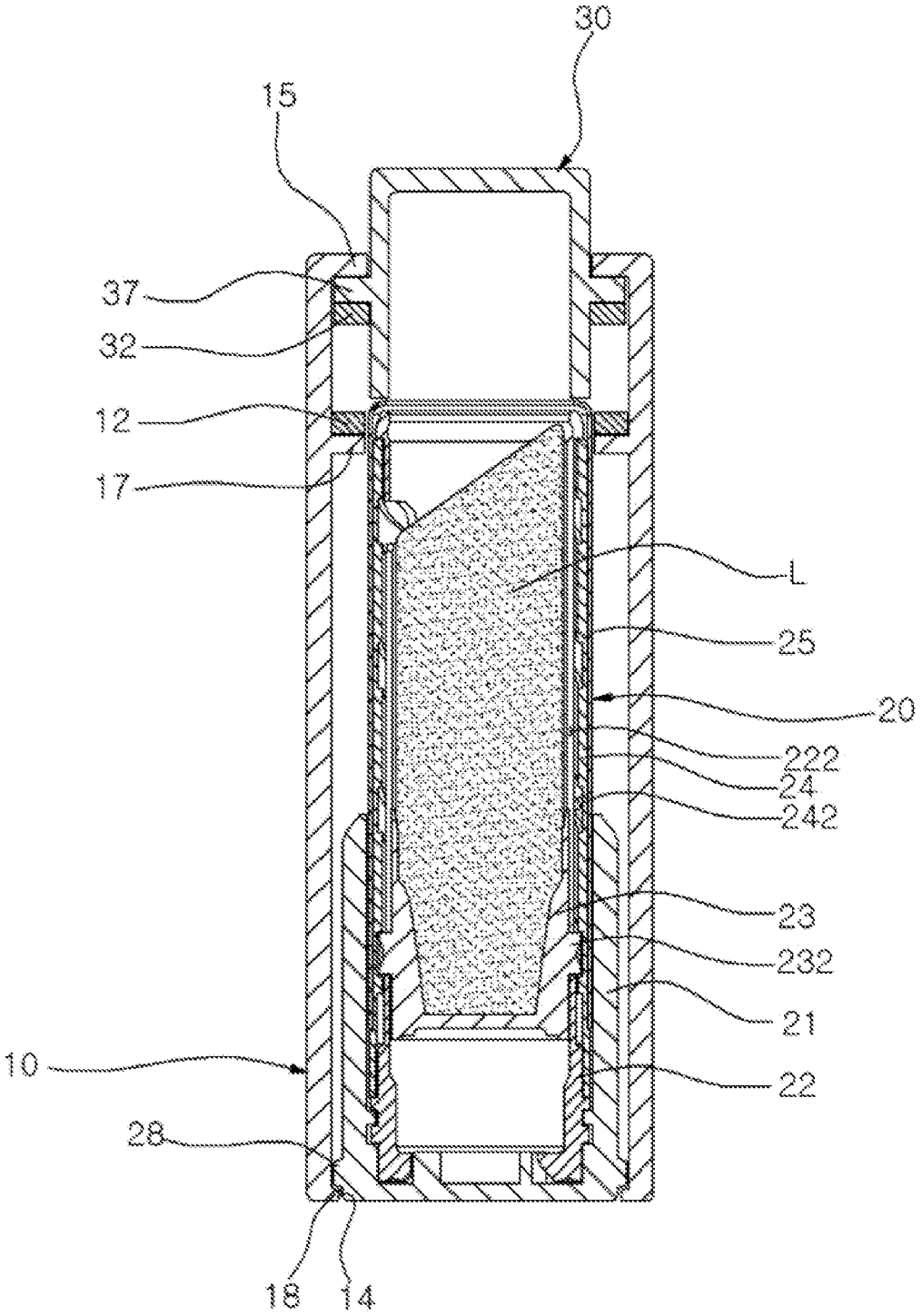
FIG. 6 is a sectional view of a cosmetic stick case according to a second aspect of the present disclosure.
Figure 7:
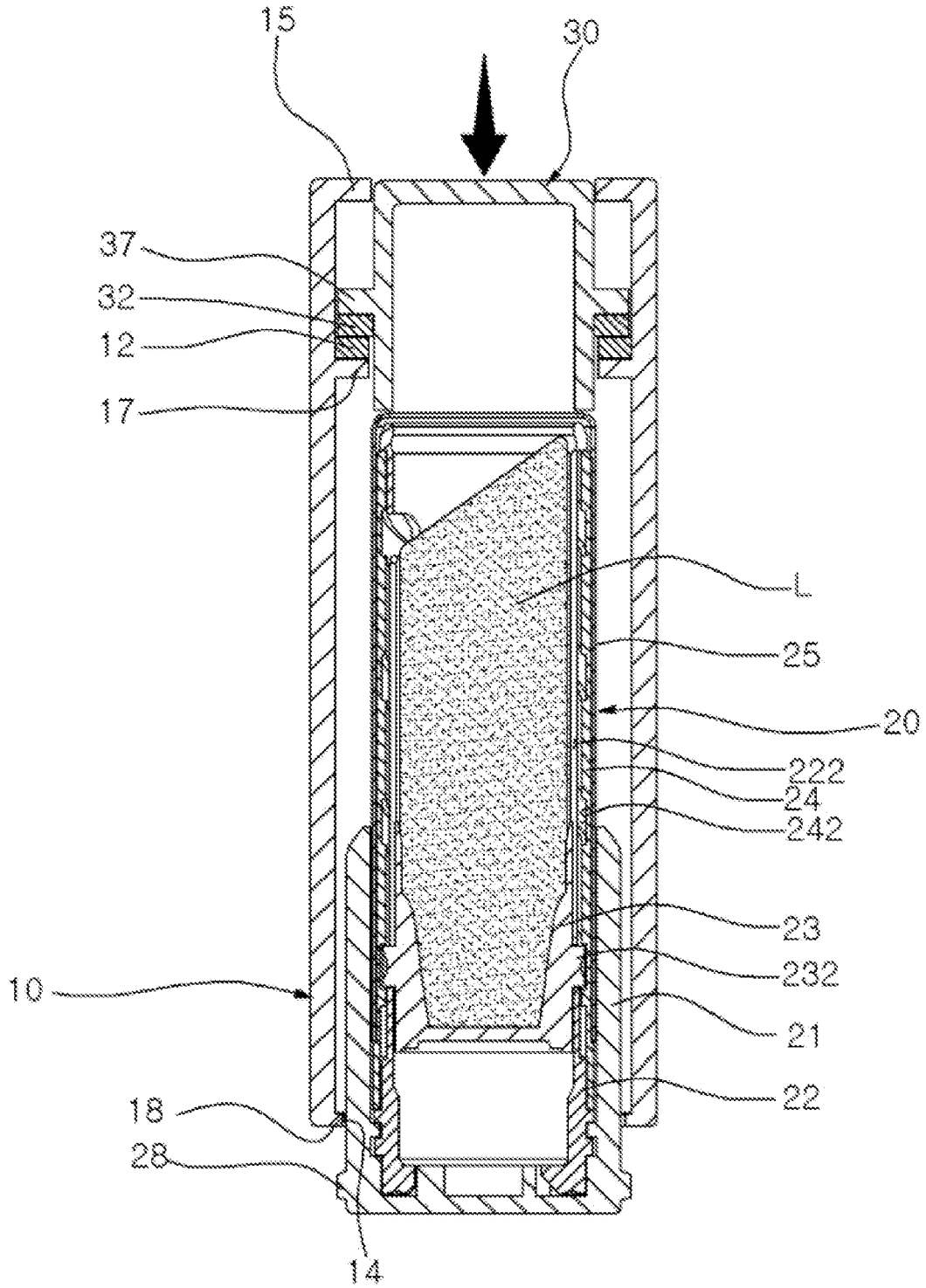
FIG. 7 is a sectional view showing a status of pressing a bush button of a cosmetic stick case according to a second aspect of the present disclosure.
Figure 8:
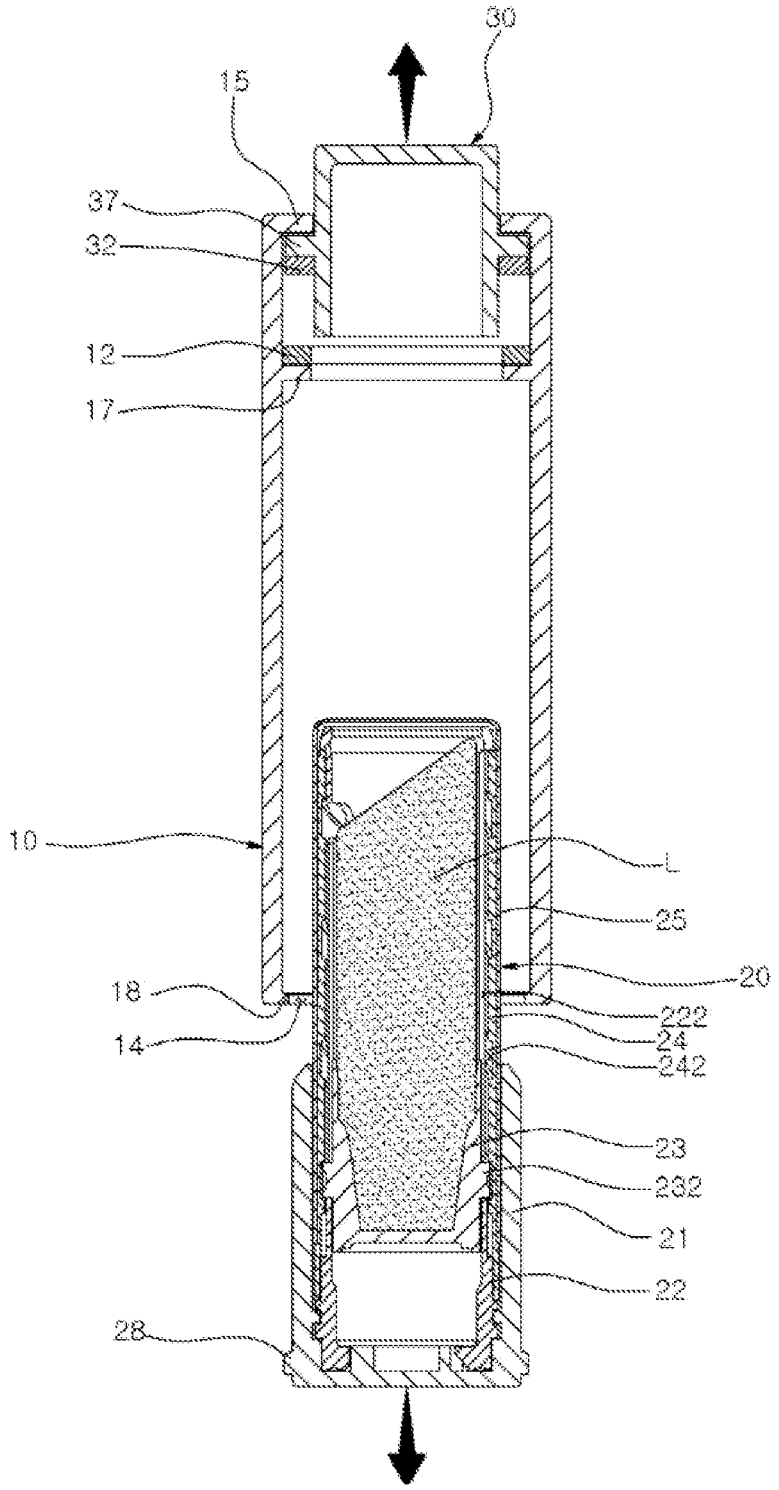
FIG. 8 is a sectional view showing a status of releasing a bush button of a cosmetic stick case according to a second aspect of the present disclosure.

FIGS. 6 to 8 are views of a cosmetic stick case according to a second aspect of the present disclosure, and the structure and operation of the cosmetic stick case according to the second aspect of the present disclosure will be described below with reference to FIGS. 6 to 8.

As shown in FIG. 6, the first magnetic force member 12 and the second magnetic force member 32 may be formed of magnets having the same pole, so that the repulsive force may be generated between the first magnetic force member 12 and the second magnetic force member 32. Thus, when the push button 30 is operated, the push button 30 may be automatically returned to its initial position.

Similar to the cosmetic stick case according to the first aspect of the present disclosure, the first magnetic force member 12 and the second magnetic force member 32 may be fixedly coupled to the first protrusion 17 of the cosmetic stick body 10 and the second protrusion 37 of the push button 30, respectively. In this case, the first magnetic force member 12 and the second magnetic force member 32 may be formed of magnets having the same pole so that the repulsive force (a pushing force between two objects) may be generated between the first magnetic force member 12 and the second magnetic force member 32.

In order to use the cosmetic stick case according to the second aspect of the present disclosure, if the user presses the push button 30 formed on one side of the cosmetic stick body 10 as shown in FIG. 7, an end of the push button 30 may push an end of the cosmetic stick 20 stored in the cosmetic stick body 10 toward the inlet 14. At the same time, the first fastening portion 18 of the cosmetic stick body 10 may be released from the second fastening portion 28 of the cosmetic stick 20 and at least a part of the cosmetic stick 20 may be drawn out to the outside from the cosmetic stick body 10.

Then, as shown in FIG. 8, as the pressed push button 30 is released, the push button 30 may be pushed by the repulsive force between the first magnetic force member 12 and the second magnetic force member 32 so that the push button 30 may automatically return to its initial position.

In addition, as described with reference to the cosmetic stick case according to the first aspect of the present disclosure, the second protrusion 37 may be caught by the stopper 15 of the cosmetic stick body 10 to limit the operation section of the push button 30, and at the same time, to prevent the push button 30 from being separated from the cosmetic stick body 10. The first magnetic force member 12 and the second magnetic force member 32 may be arranged to face each other in the operating direction of the push button 30 such that the repulsive force of the magnet can be generated between the first magnetic force member 12 and the second magnetic force member 32.

Figure 9:
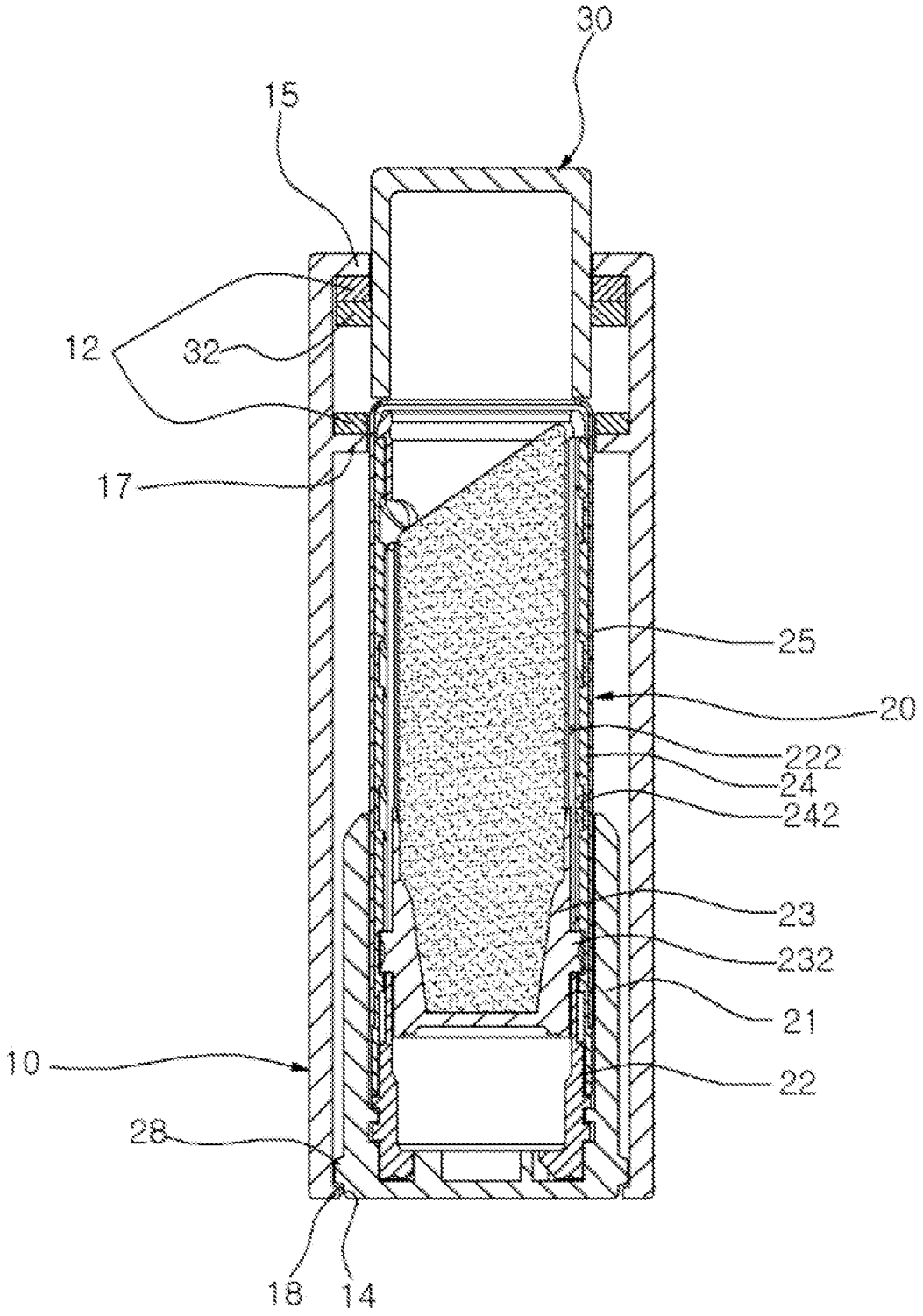
FIG. 9 is a sectional view of a cosmetic stick case according to a third aspect of the present disclosure.
Figure 10:
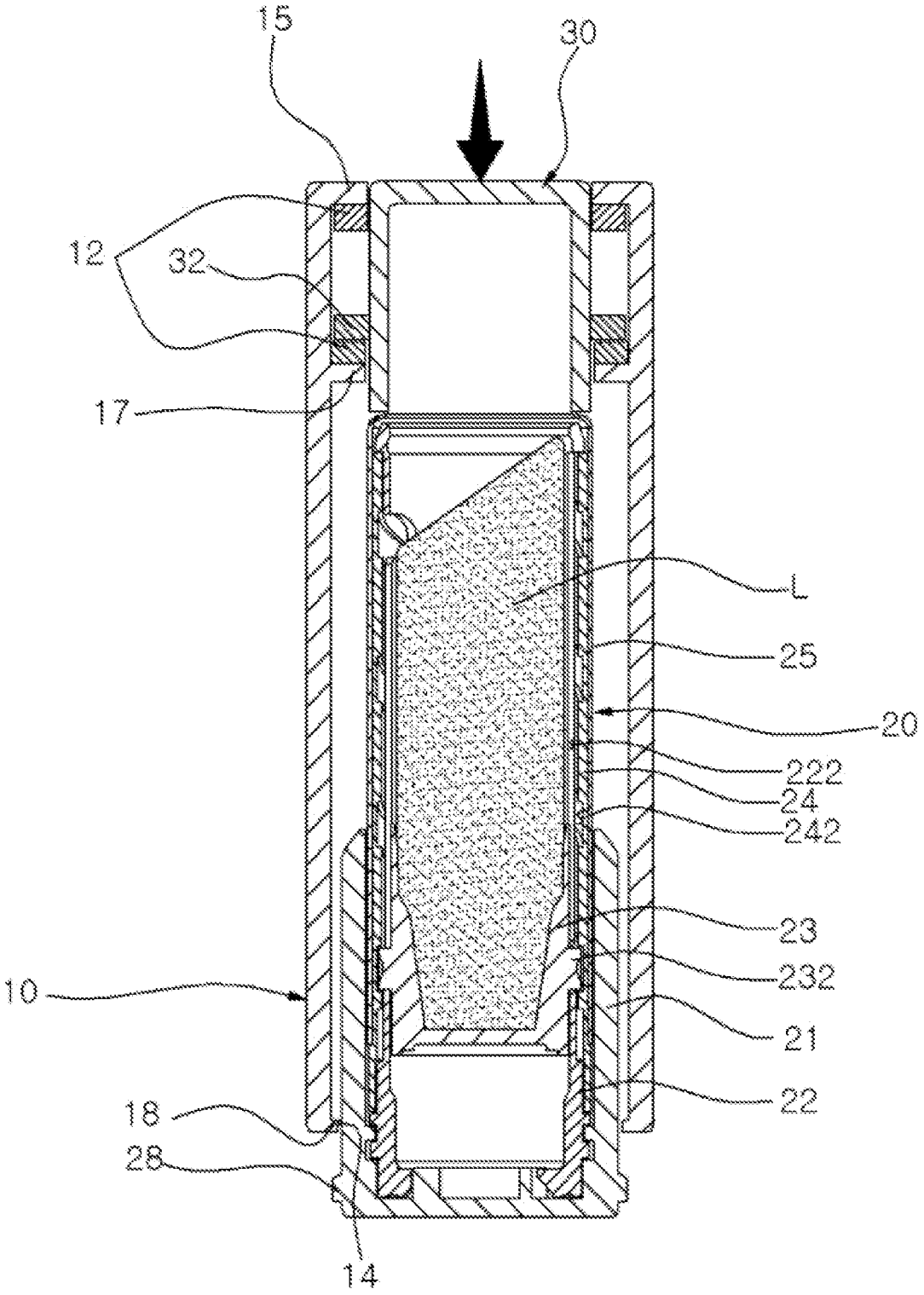
FIG. 10 is a sectional view showing a status of pressing a bush button of a cosmetic stick case according to a third aspect of the present disclosure.
Figure 11:
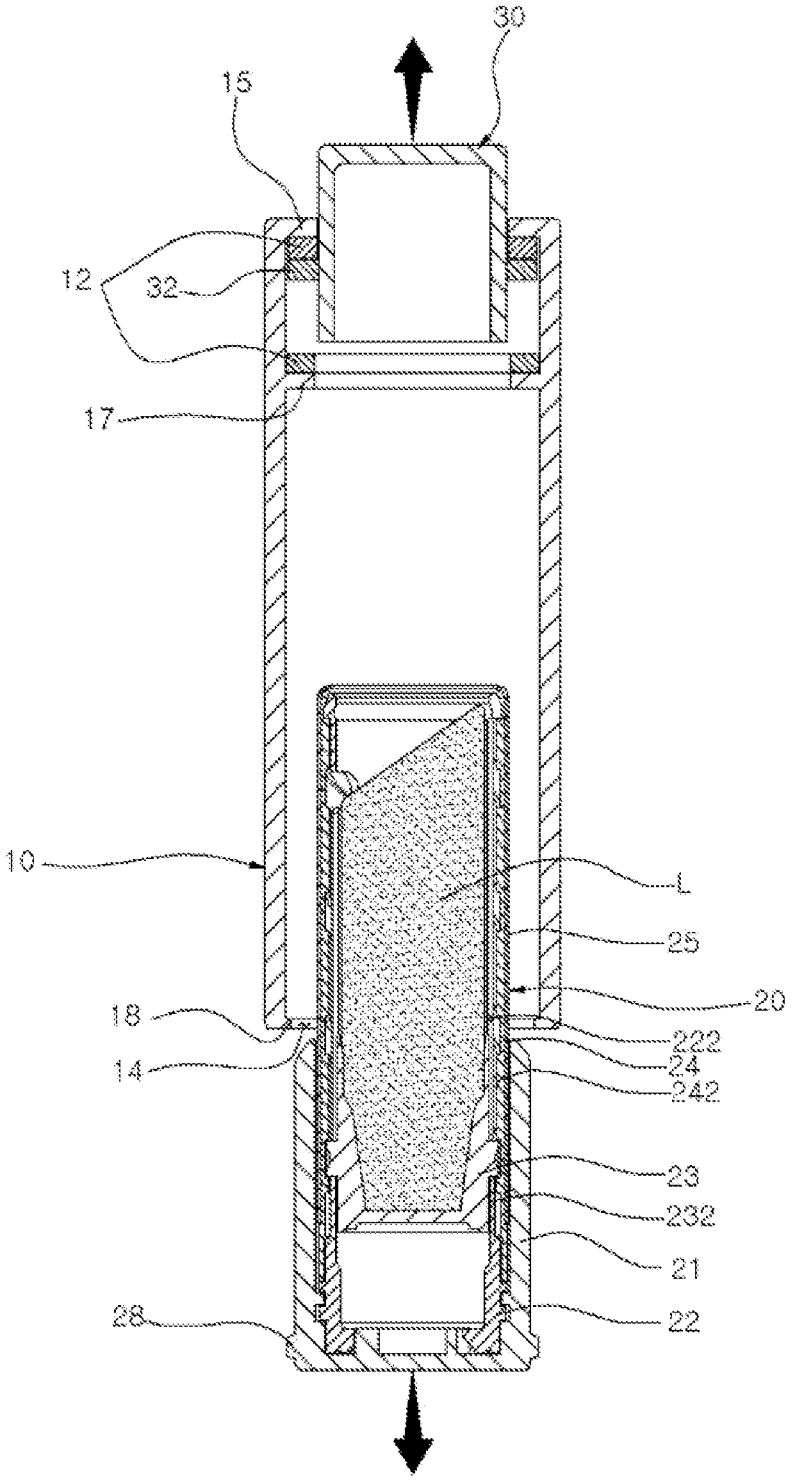
FIG. 11 is a sectional view showing a status of releasing a bush button of a cosmetic stick case according to a third aspect of the present disclosure.

FIGS. 9 to 11 are views of a cosmetic stick case according to a third aspect of the present disclosure, and the structure and operation of the cosmetic stick case according to the third aspect of the present disclosure will be described below with reference to FIGS. 9 to 11.

As shown in FIG. 9, the first magnetic force member 12 may include a pair of magnets having mutually different poles, and the second magnetic force member 32 may be formed of a magnet and located between the pair of first magnetic force members 12.

More specifically, a pair of first magnetic force members 12 may be fixedly coupled to the stopper 15 and the first protrusion 17 of the cosmetic stick body 10, respectively, and the pair of first magnetic force members 12 may face each other while being spaced apart from each other by a predetermined interval in the operating direction of the push button 30. In addition, the second magnetic force member 32 may be fixedly coupled to the outer periphery of the push button 30 and located between the pair of first magnetic force members 12. In this case, the pair of first magnetic force members 12 may be formed of magnets having mutually different poles, so that the attractive force and the repulsive force of the magnets may be simultaneously generated between the pair of first magnetic force members 12 and the second magnetic force members 32.

That is, the second magnetic force member 32 may have the pole the same as the pole of the first magnetic force member 12 located in the pressing direction of the push button 30 so that the repulsive force may be generated, and the second magnetic force member 32 may have the pole different from the pole of the first magnetic force member 12 located in the return direction of the push button 30, so that the attractive force may be generated. Accordingly, when the push button 30 is operated, the push button 30 may be automatically returned to its initial position by the simultaneous action of the repulsive force and the attractive force of the magnets.

In order to use the cosmetic stick case according to the third aspect of the present disclosure, if the user presses the push button 30 formed on one side of the cosmetic stick body 10 as shown in FIG. 10, an end of the push button 30 may push an end of the cosmetic stick 20 stored in the cosmetic stick body 10 toward the inlet 14. At the same time, the first fastening portion 18 of the cosmetic stick body 10 may be released from the second fastening portion 28 of the cosmetic stick 20 and at least a part of the cosmetic stick 20 may be drawn out to the outside from the cosmetic stick body 10.

Then, as shown in FIG. 11, as the pressed push button 30 is released, the repulsive force between the first magnetic force member 12 and the second magnetic force member 32 that are in contact with each other and the attractive force between the first magnetic force member 12 and the second magnetic force member 32 that are spaced apart from each other may be simultaneously generated, so that the push button 30 may be automatically returned to its initial position.

In addition, as described with reference to the cosmetic stick case according to the first aspect of the present disclosure, the second protrusion 37 may be caught by the stopper 15 of the cosmetic stick body 10 to limit the operation section of the push button 30, and at the same time, to prevent the push button 30 from being separated from the cosmetic stick body 10. Further, the first magnetic force member 12 and the second magnetic force member 32 may be arranged to face each other in the operating direction of the push button 30 such that the attractive force or repulsive force of the magnet can be generated.

Figure 12:
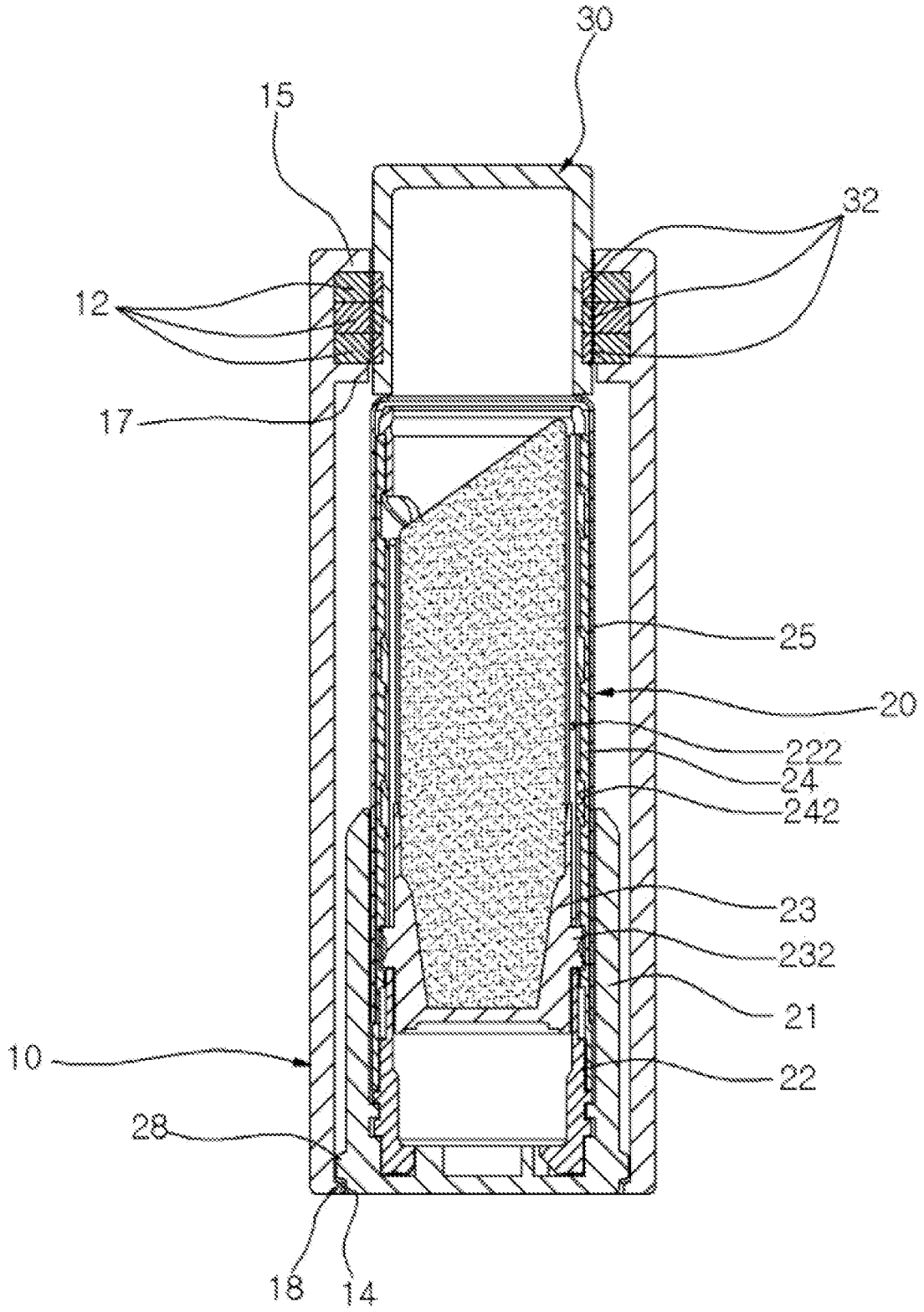
FIG. 12 is a sectional view of a cosmetic stick case according to a fourth aspect of the present disclosure.
Figure 13:
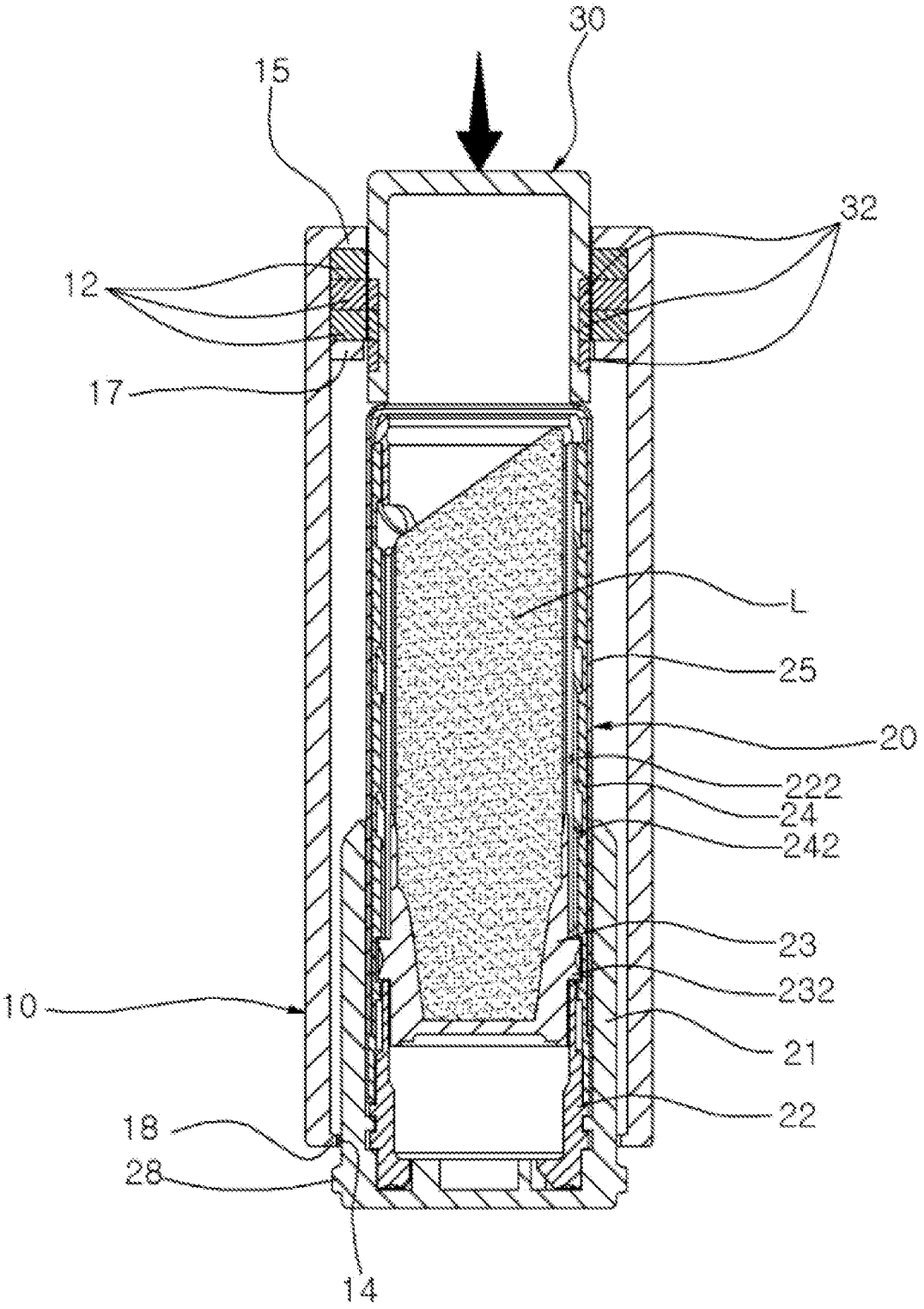
FIG. 13 is a sectional view showing a status of pressing a bush button of a cosmetic stick case according to a fourth aspect of the present disclosure.
Figure 14:
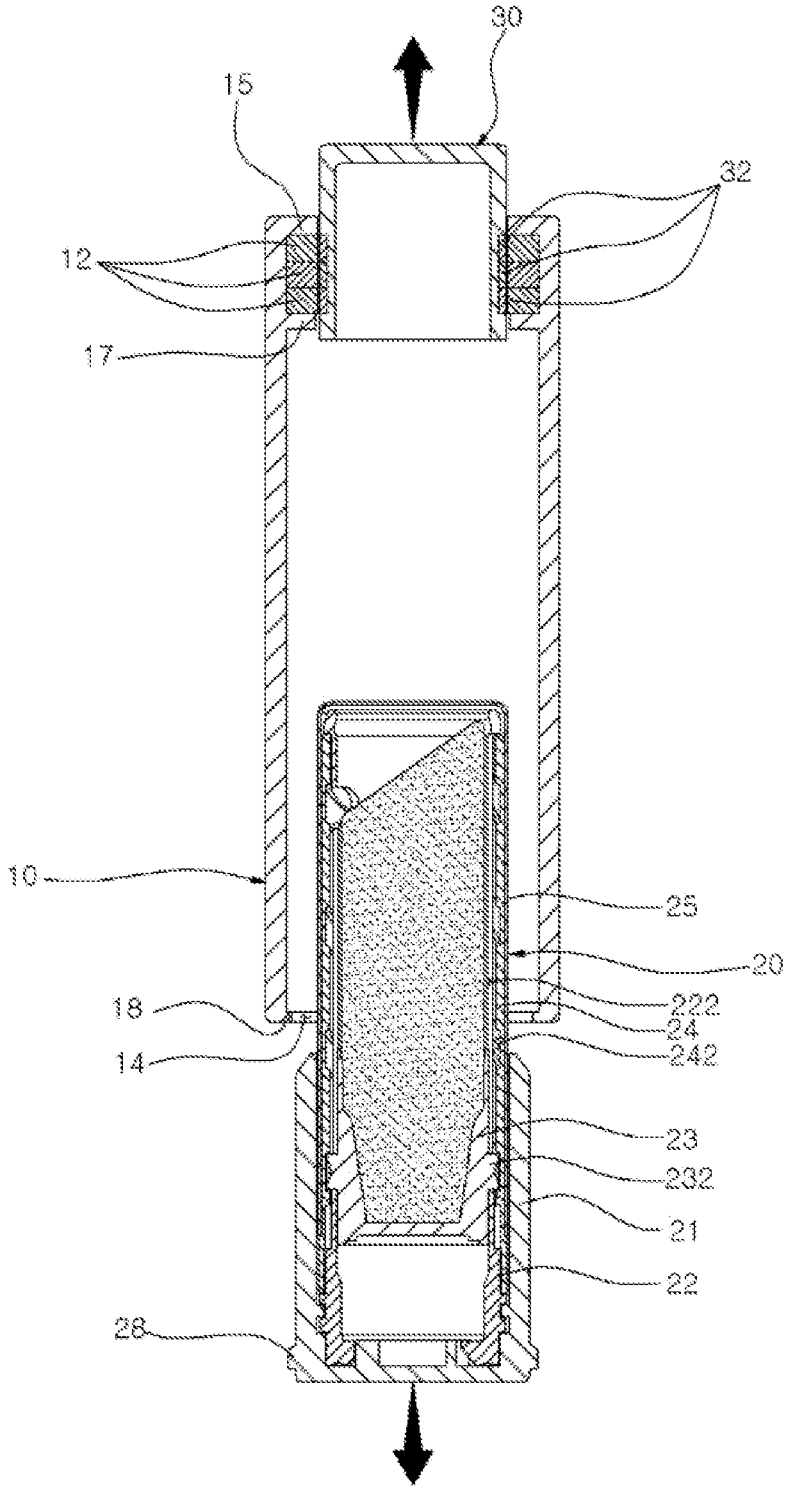
FIG. 14 is a sectional view showing a status of releasing a bush button of a cosmetic stick case according to a fourth aspect of the present disclosure.

FIGS. 12 to 14 are views of a cosmetic stick case according to a fourth aspect of the present disclosure, and the structure and operation of the cosmetic stick case according to the fourth aspect of the present disclosure will be described below with reference to FIGS. 12 to 14.

As shown in FIG. 12, the first magnetic force member 12 and the second magnetic force member 32 may be formed of magnets alternately arranged with different poles in the operating direction of the push button 30, and the first magnetic force member 12 and the second magnetic force member 32 may be arranged such that magnets having mutually different poles may face each other.

More specifically, the first magnetic force member 12 may be fixedly coupled between the stopper 15 and the first protrusion 17 of the cosmetic stick body 10, and the second magnetic force member 32 may be fixedly coupled the outer periphery of the push button 30. The first and second magnetic force members 12 and 32 may be formed by stacking at least two magnets having mutually different poles, and the second magnetic force members 12 may be arranged to face each other within the first magnetic force members 12. In this case, since the magnets of the first magnetic force member 12 and the second magnetic force member 32, which face each other, have mutually different poles, the attractive force or repulsive force of the magnet may be selectively generated between the first magnetic force member 12 and the second magnetic force member 32 depending on the operation of the push button 30. For example, when the first magnetic force member 12 includes the magnets having the poles of N-S-N in the operating direction of the push button 30, the second magnetic force member 32 may include the magnets having poles of S-N-S. In contrast, when the first magnetic force member 12 includes the magnets having the poles of S-N-S in the operating direction of the push button 30, the second magnetic force member 32 may include the magnets having the poles of N-S-N.

That is, when the first magnetic force member 12 and the second magnetic force member 32 are arranged to face each other, the attractive force of the magnet may be generated. In addition, when the first magnetic force member 12 and the second magnetic force member 32 are arranged to offset from each other, the repulsive force of the magnet may be generated. Accordingly, when the push button 30 is operated, the push button 30 may be automatically returned to its initial position.

The attractive force or repulsive force generated between the first magnetic force member 12 of the cosmetic stick body 10 and the second magnetic force member 32 of the push button 30 may be orientated in the direction perpendicular to the operating direction of the push button 30.

In order to use the cosmetic stick case according to the fourth aspect of the present disclosure, if the user presses the push button 30 formed on one side of the cosmetic stick body 10 as shown in FIG. 13, an end of the push button 30 may push an end of the cosmetic stick 20 stored in the cosmetic stick body 10 toward the inlet 14. At the same time, the first fastening portion 18 of the cosmetic stick body 10 may be released from the second fastening portion 28 of the cosmetic stick 20 and at least a part of the cosmetic stick 20 may be drawn out to the outside from the cosmetic stick body 10.

In this case, the position of the first magnetic force member 12 formed on the cosmetic stick body 10 may be offset from the position of the second magnetic force member 32 formed on the push button 30, so that the magnets of the first magnetic force member 12 and the second magnetic force member 32 having the same pole may face each other, thereby generating the repulsive force of the magnets.

Then, as shown in FIG. 14, as the pressed push button 30 is released, the push button 30 may return to its initial position due to the repulsive force of the first magnetic force member 12 and the second magnetic force member 32. As the push button 30 returns to its initial position, the stacked magnets of the first magnetic force member 12 and the second magnetic force member 32 having mutually different poles may face each other so that the first magnetic force member 12 and the second magnetic force member 32 may be fixed due to the attractive force of the magnets.

Figure 15:
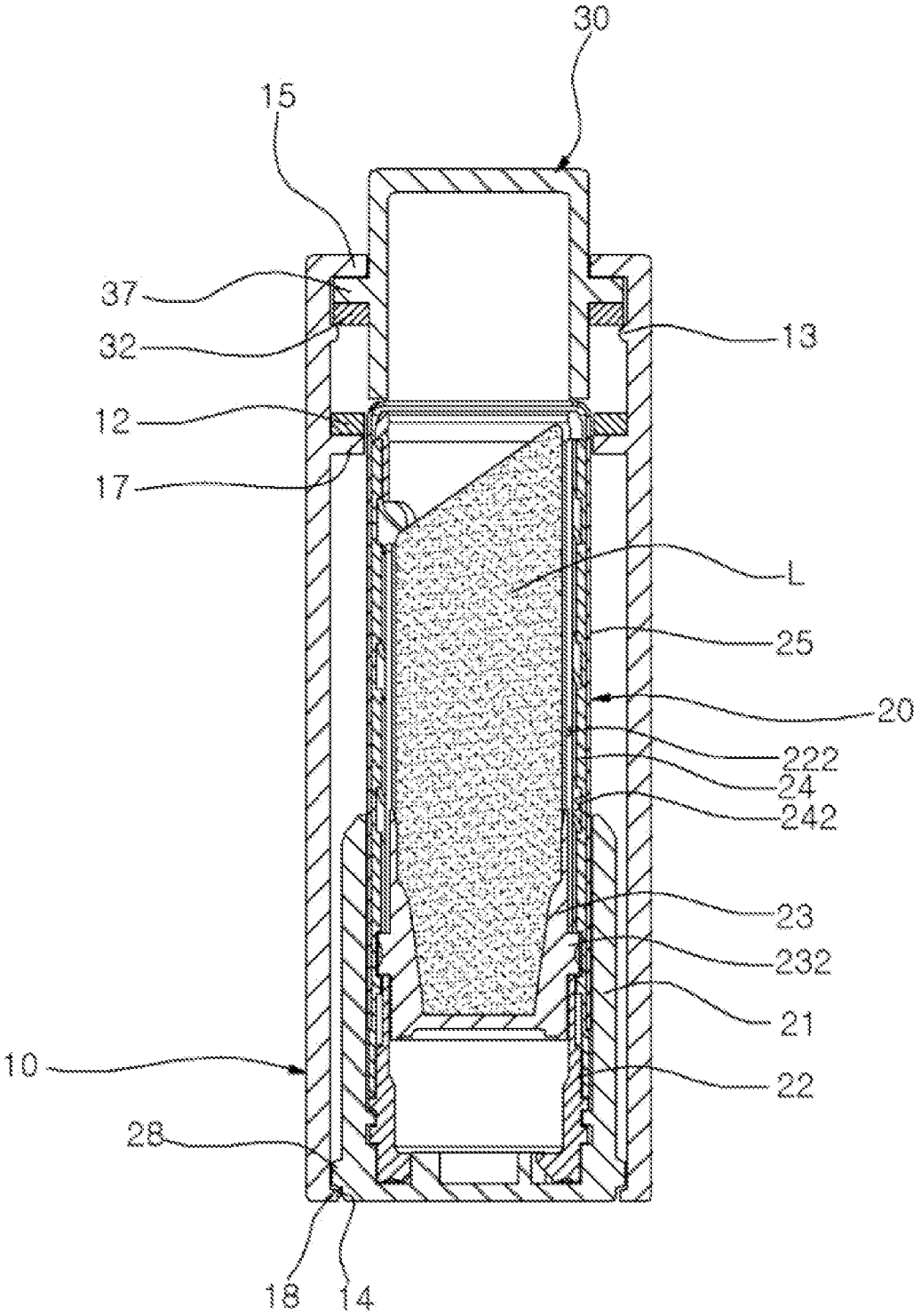
FIG. 15 is a sectional view showing a latching protrusion formed on a cosmetic stick case according to one aspect of the present disclosure.
Figure 16:
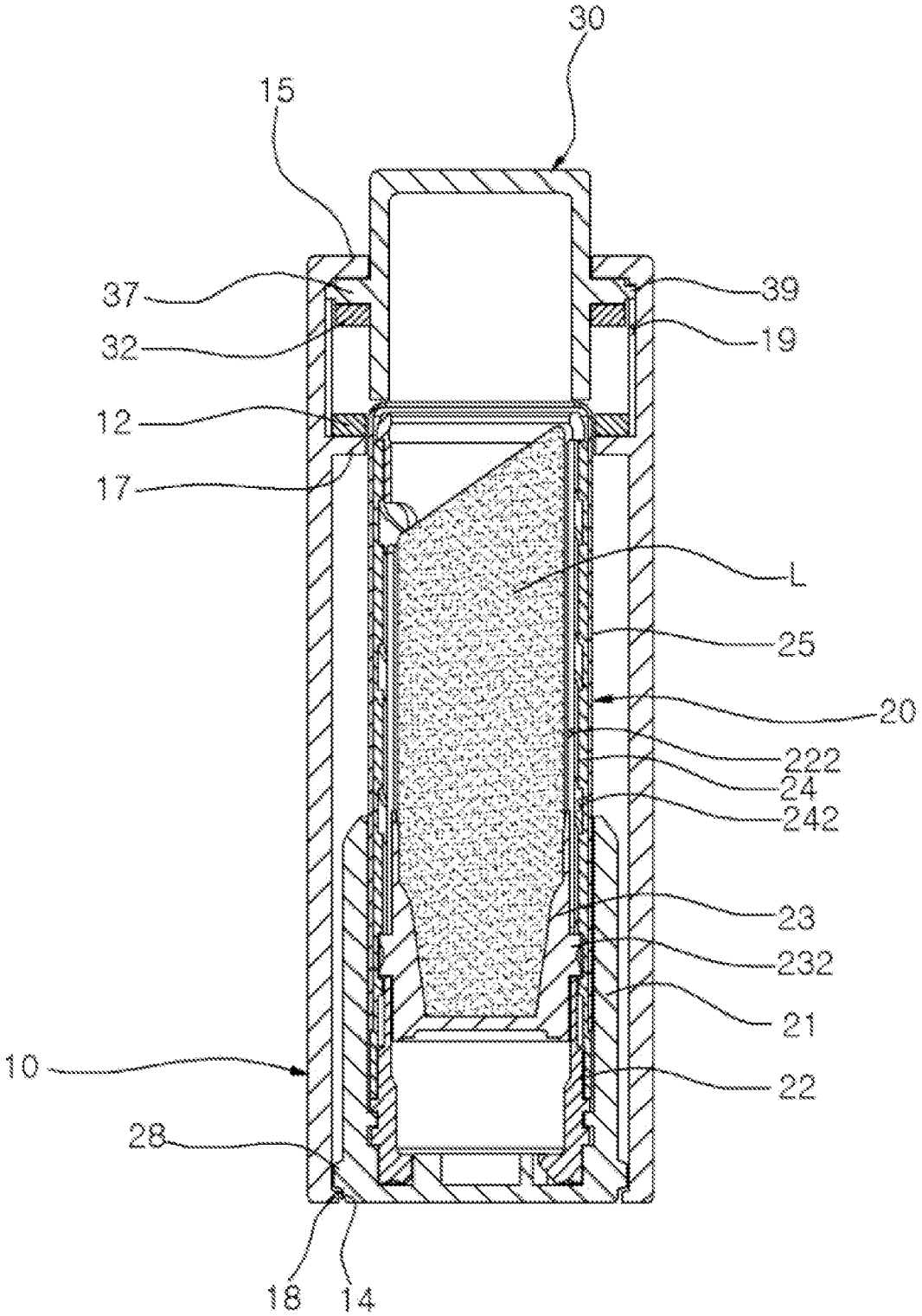
FIG. 16 is a sectional view showing a linear guide groove and a protrusion formed on a cosmetic stick case according to one aspect of the present disclosure.
Figure 17:
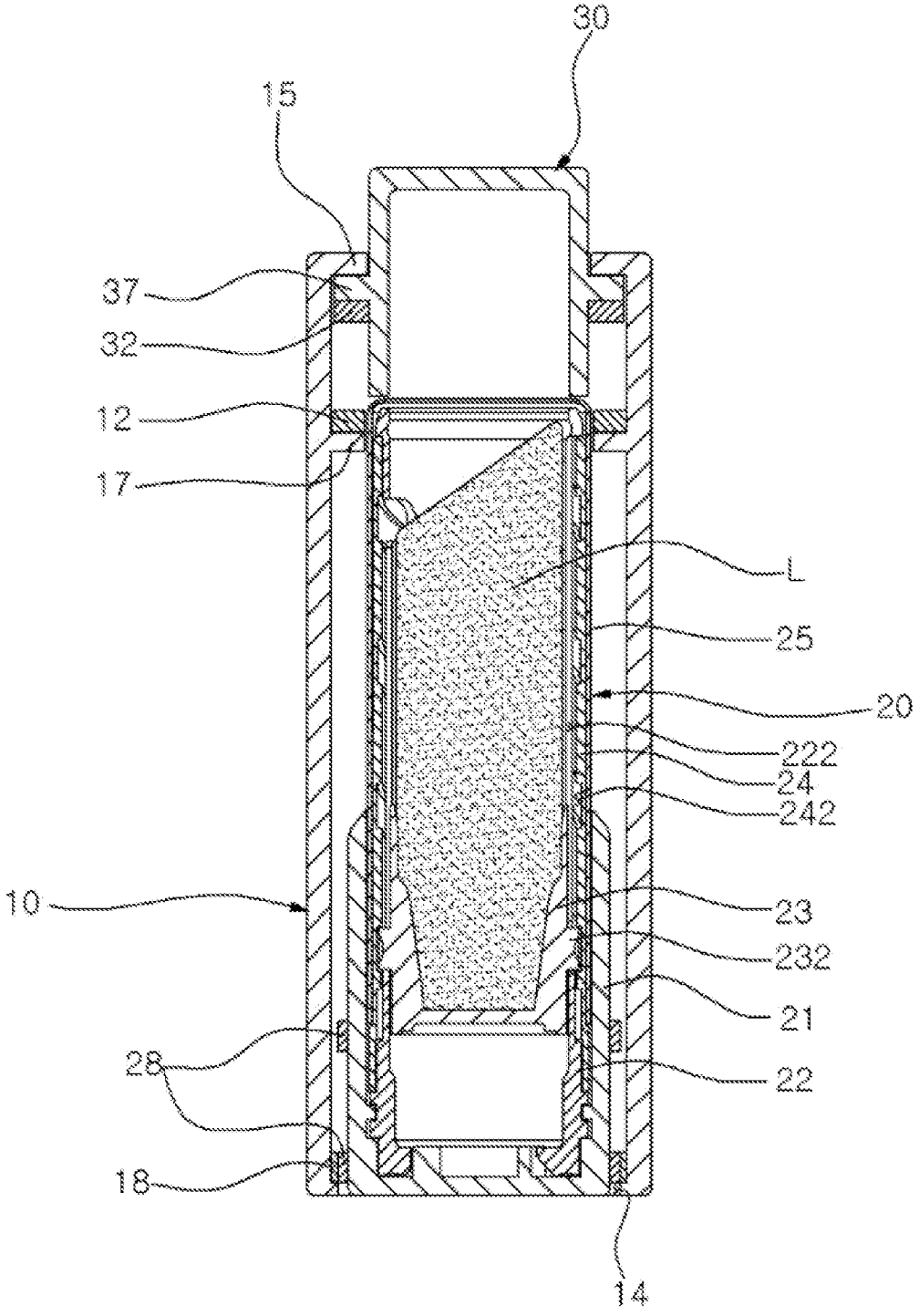
FIGS. 17 and 18 are sectional views showing a double fastening structure between a cosmetic stick body and a cosmetic stick of a cosmetic stick case according to one aspect of the present disclosure for preventing the cosmetic stick from being separated from the cosmetic stick body.
Figure 18:
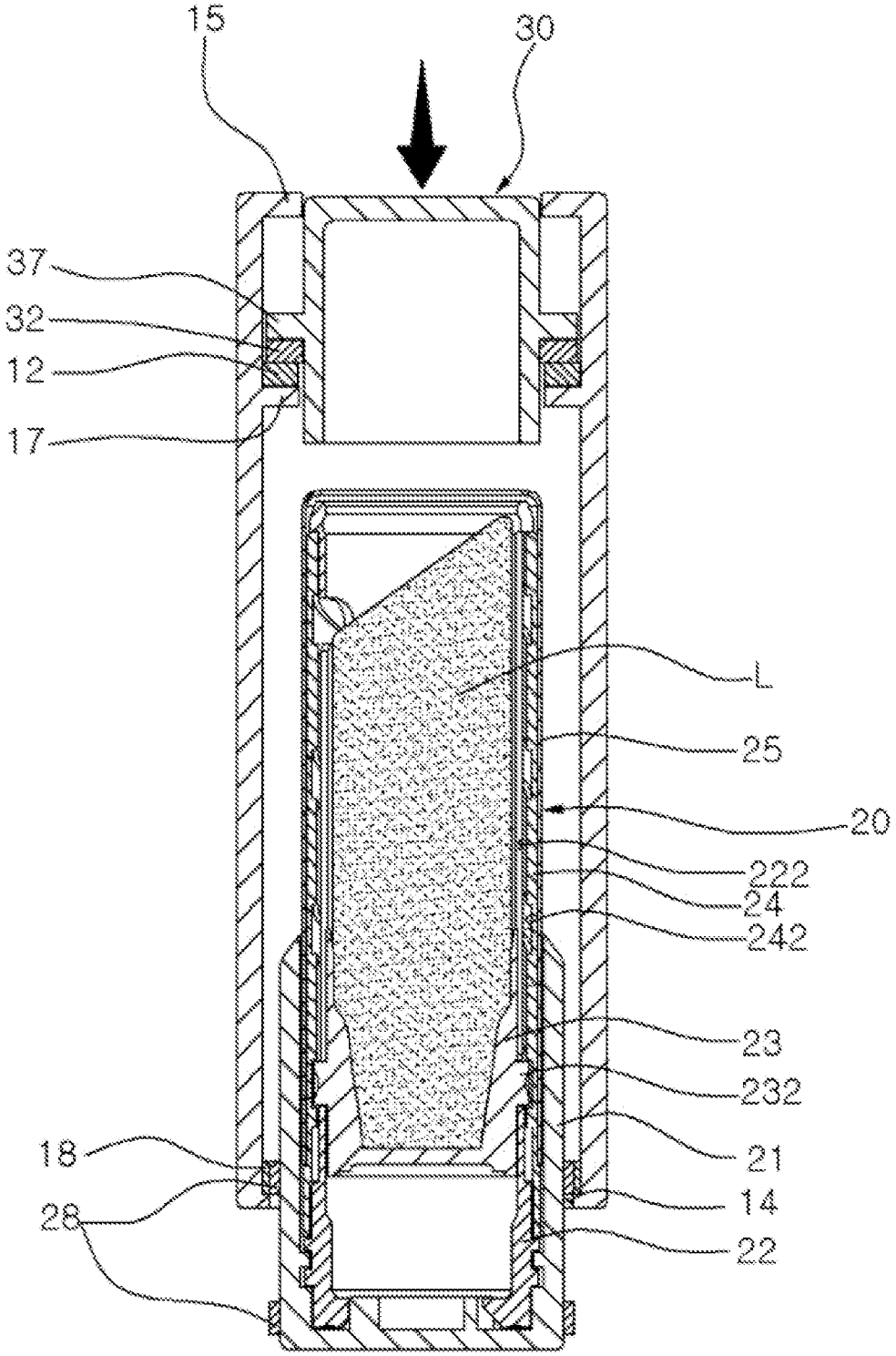

FIGS. 15 and 16 are sectional views illustrating a state in which a latching protrusion, a linear guide groove and a protrusion are formed in a cosmetic stick case according to one aspect of the present disclosure, and FIGS. 17 and 18 are sectional views showing a double fastening structure between a cosmetic stick body and a cosmetic stick of a cosmetic stick case according to one aspect of the present disclosure for preventing the cosmetic stick from being separated from the cosmetic stick body.

As shown in FIG. 15, the latching protrusion 13 may protrude inward from an inner periphery of the cosmetic stick body 10, so that the second magnetic force member 32 of the push button 30 may be caught by the latching protrusion 13 when the push button 30 is pressed.

That is, the push button 30 may be easily pressed by mistake or external impact during storage or carrying. In this case, the fastening between the cosmetic stick body 10 and the cosmetic stick 20 may be released, thereby causing the cosmetic stick 20 to be separated from the cosmetic stick body 10. In this regard, the latching protrusion 13 may be provided in a section of the inner periphery of the cosmetic stick body 10 where the second magnetic force member 32 of the push button 30 is reciprocated, thereby preventing the push button 30 from being unintentionally pressed.

In addition, as shown in FIG. 16, a linear guide groove 19 and a linear guide protrusion 39 may be formed on the cosmetic stick body 10 and the push button 30, respectively, to guide the linear movement of the push button 30. Thus, when the push button 30 is pressed, the push button 30 may stably move linearly within the cosmetic stick body 10 without being rotated.

Further, as shown in FIG. 17, two or more second fastening portions 28 may be formed on the cosmetic stick 20 to prevent the cosmetic stick 20 from being completely separated from the cosmetic stick body 10 when the cosmetic stick 20 is drawn out.

That is, when the cosmetic stick 20 is drawn out to the outside by the pressing operation of the push button 30, the fastening between the cosmetic stick body 10 and the cosmetic stick 20 may be released, and at the same time, the cosmetic stick 20 may suddenly fall down from the cosmetic stick body 10 by gravity. In this regard, the second fastening portion 28 may be doubly formed on the cosmetic stick 20. In this case, even if the cosmetic stick 20 falls down from the cosmetic stick body 10 when the fastening between the cosmetic stick 20 and the cosmetic stick body 10 is released, the cosmetic stick 20 may be fastened again to the cosmetic stick body 10 due to the undercut coupling or the attractive force of the magnet.

What is claimed is:

1. A cosmetic stick case using a magnetic force, the cosmetic stick case comprising:

a cosmetic stick body;

a cosmetic stick inserted into the cosmetic stick body; and a push button for drawing out the cosmetic stick to an outside by a pressing operation, wherein the cosmetic stick body is provided with a first magnetic force member and the push button is provided with a second magnetic force member so that the push button is fixed without being shaken by the magnetic force.

2. The cosmetic stick case of claim 1, wherein the cosmetic stick body is provided with a first fastening portion and the cosmetic stick is provided with a second fastening portion so that the cosmetic stick body and the cosmetic stick are fastened to each other.

3. The cosmetic stick case of claim 2, wherein one of the first fastening portion and the second fastening portion is formed of a magnet, and the other is formed of a magnet or a magnetic member so that the first and second fastening portions are fastened to each other by the magnetic force.

4. The cosmetic stick case of claim 2, wherein the first fastening portion and the second fastening portion are configured as protrusions facing each other so that the first fastening portion and the second fastening portion are undercut-fastened.

5. The cosmetic stick case of claim 2, wherein at least two fastening portions are provided on the cosmetic stick so that the cosmetic stick is prevented from being completely separated from the cosmetic stick body when the cosmetic stick is drawn out.

6. The cosmetic stick case of claim 1, wherein the first magnetic force member and the second magnetic force member have ring shapes.

7. The cosmetic stick case of claim 1, wherein the cosmetic stick body is formed at an inner periphery thereof with a latching protrusion, which protrudes inward, so that the second magnetic force member of the push button is caught by the latching protrusion when the push button is pressed.

8. The cosmetic stick case of claim 1, wherein the cosmetic stick body and the push button are provided with a linear guide groove and a linear guide protrusion, respectively, to guide a linear movement of the push button.

9. The cosmetic stick case of claim 1, wherein one of the first magnetic force member and the second magnetic force member is formed of a magnet, and the other is formed of a magnet or a magnetic member so that attractive force of the magnet is generated between the first magnetic force member and the second magnetic force member, thereby fixing the push button in a pressed state upon a pressing operation of the push button.

10. The cosmetic stick case of claim 1, wherein the first magnetic force member and the second magnetic force member are formed of magnets having the same pole so that repulsive force of the magnet is generated between the first magnetic force member and the second magnetic force member, thereby allowing the push button to automatically return to an initial position thereof upon a pressing operation of the push button.

11. The cosmetic stick case of claim 1, wherein the first magnetic force member is formed of a pair of magnets having mutually different poles, and the second magnetic force member is formed of a magnet and positioned between the pair of first magnetic force members.

12. The cosmetic stick case of claim 11, wherein the second magnetic force member has a pole the same as a pole of the first magnetic force member, which is positioned in a pressing direction of the push button between the pair of first magnetic force members, to generate repulsive force, and has a pole different from a pole of the first magnetic force member, which is positioned in a return direction of the push button, to generate attractive force.

13. The cosmetic stick case of claim 9, wherein the attractive force or repulsive force generated between the first magnetic force member and the second magnetic force member is directed in an operation direction of the push button.

14. The cosmetic stick case of claim 1, wherein the first magnetic force member and the second magnetic force member are formed of magnets which are arranged such that different poles are alternately arranged along an operation direction of the push button, and the first magnetic force member and the second magnetic force member are positioned such that the magnets having mutually different poles face each other.

15. The cosmetic stick case of claim 14, wherein attractive force of the magnets is generated when the first magnetic force member and the second magnetic force member are positioned to face each other, and repulsive force of the magnets is generated when the first magnetic force member and the second magnetic force member are positioned to offset from each other.

16. The cosmetic stick case of claim 14, wherein attractive force or repulsive force generated between the first magnetic force member and the second magnetic force member is directed in a direction perpendicular to an operation direction of the push button.

17. The cosmetic stick case of claim 10, wherein attractive force or repulsive force generated between the first magnetic force member and the second magnetic force member is directed in an operation direction of the push button.

18. The cosmetic stick case of claim 11, wherein attractive force or repulsive force generated between the first magnetic force member and the second magnetic force member is directed in an operation direction of the push button.

* * * * *